US009213353B2

(12) United States Patent
Siao

(10) Patent No.: US 9,213,353 B2
(45) Date of Patent: Dec. 15, 2015

(54) BAND GAP REFERENCE CIRCUIT

(71) Applicant: Taiwan Semiconductor Manufacturing Company Limited, Hsin-Chu (TW)

(72) Inventor: Yuan-Long Siao, Kaohsiung (TW)

(73) Assignee: Taiwan Semiconductor Manufacturing Company Limited, Hsin-Chu (TW)

( * ) Notice: Subject to any disclaimer, the term of this patent is extended or adjusted under 35 U.S.C. 154(b) by 365 days.

(21) Appl. No.: 13/798,928

(22) Filed: Mar. 13, 2013

(65) Prior Publication Data

US 2014/0266138 A1 Sep. 18, 2014

(51) Int. Cl.
*G05F 3/16* (2006.01)
*G05F 3/30* (2006.01)

(52) U.S. Cl.
CPC ..... *G05F 3/30* (2013.01)

(58) Field of Classification Search
CPC ..... G05F 3/16; G05F 3/30
USPC ..... 323/313–317; 327/538–543
See application file for complete search history.

(56) References Cited

U.S. PATENT DOCUMENTS

| | | | | |
|---|---|---|---|---|
| 5,961,215 | A * | 10/1999 | Lee et al. | 374/178 |
| 6,411,158 | B1 * | 6/2002 | Essig | 327/539 |
| 6,882,213 | B2 * | 4/2005 | Kim | 327/512 |
| 7,286,002 | B1 | 10/2007 | Jackson | |
| 2006/0284668 | A1 * | 12/2006 | Chou | 327/539 |
| 2010/0060345 | A1 * | 3/2010 | Huang et al. | 327/539 |

* cited by examiner

*Primary Examiner* — Matthew Nguyen
(74) *Attorney, Agent, or Firm* — Cooper Legal Group, LLC

(57) ABSTRACT

A band gap reference circuit is provided that includes a first resistor (R1), a second resistor (R2), a third resistor (R3), a fourth resistor (Ra), a fifth resistor (Rb), a capacitor (Ca), an operational amplifier A, a first field effect transistor (FET) (P1), a second FET (P2), a third FET (P3), a fourth FET (Pa), a first bipolar junction transistor (BJT) (Q1), a second BJT (Q2), and a third BJT (Q3). P3 and Rb are used to control Pa, which is configured to control current flow to a reference node, and thus a reference voltage (Vref) output by the band gap reference circuit. The band gap reference circuit is configured to output a substantially constant reference voltage and is less sensitive or susceptible to noise from a power supply. Additionally, the band gap reference circuit prevents Vref from overshooting when the band gap circuit is enabled.

20 Claims, 5 Drawing Sheets

BAND GAP REFERENCE CIRCUIT

BACKGROUND

A band gap reference circuit is a circuit configured to output a reference voltage, such as around 1.25 V, to other circuits requiring a substantially constant reference voltage. Some band gap reference circuits also generate a reference current for biasing circuits, for example.

BRIEF DESCRIPTION OF THE DRAWINGS

Aspects of the disclosure are understood from the following detailed description when read with the accompanying drawings. It will be appreciated that elements, structures, etc. of the drawings are not necessarily drawn to scale. Accordingly, the dimensions of the same may be arbitrarily increased or reduced for clarity of discussion, for example.

DETAILED DESCRIPTION

Figure 1:
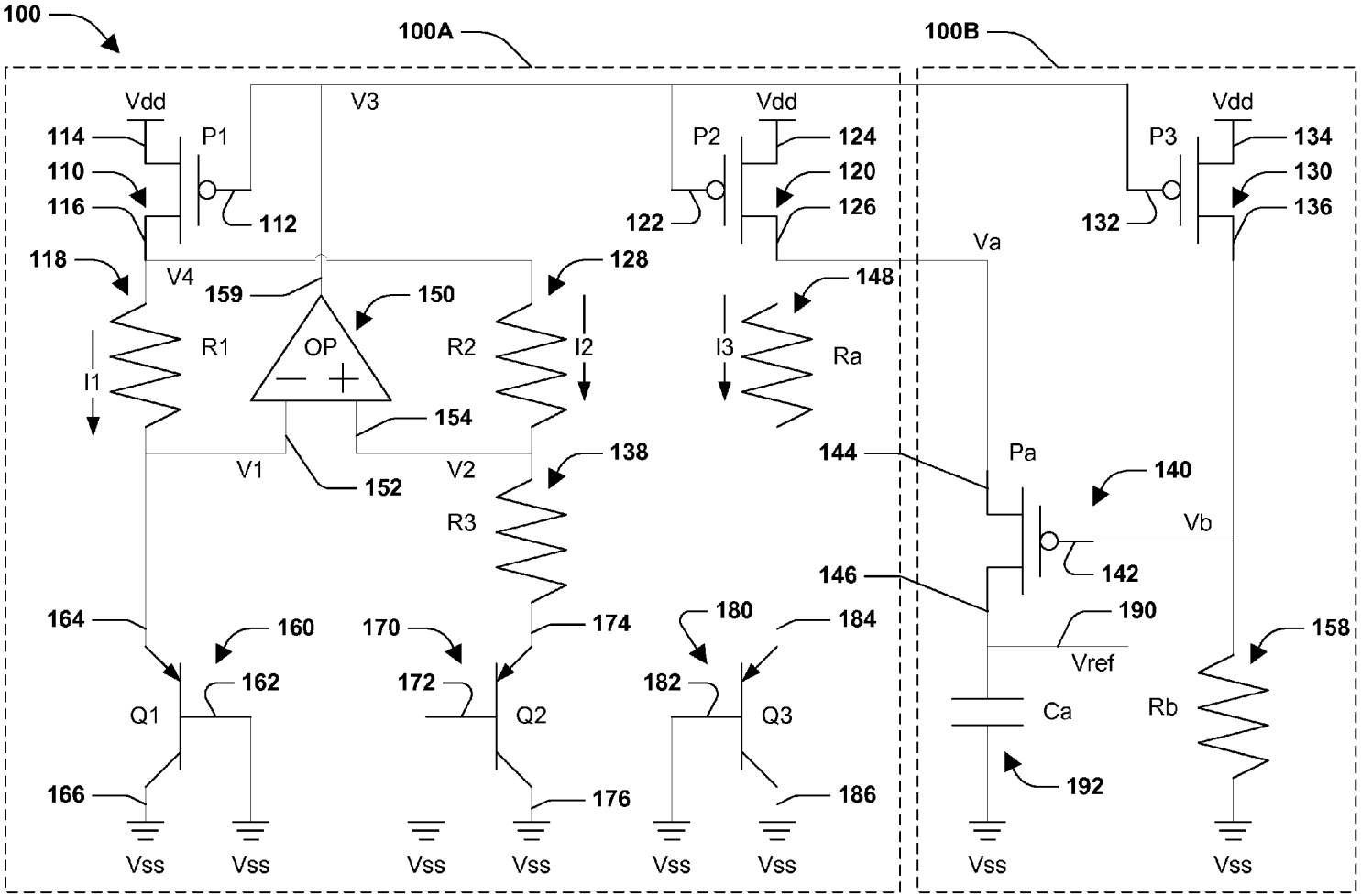
FIG. 1 is a schematic diagram of a band gap reference circuit, according to some embodiments.

Embodiments or examples, illustrated in the drawings are disclosed below using specific language. It will nevertheless be understood that the embodiments or examples are not intended to be limiting. Any alterations and modifications in the disclosed embodiments, and any further applications of the principles disclosed in this document are contemplated as would normally occur to one of ordinary skill in the pertinent art.

When a power supply level associated with a band gap reference circuit is switched higher or lower for wide range power supply operation or when power supply noise occurs, the band gap reference circuit, in some instances, experiences noise such that a reference voltage (Vref) output by the band gap reference circuit is unstable or otherwise other than intended. Additionally, when a band gap reference circuit is enabled or turned on, a Vref output by the band gap reference circuit, in some instances, exceeds or overshoots a desired Vref level. In some embodiments herein, a band gap reference circuit is provided that is less sensitive or susceptible to noise from the power supply. In some embodiments herein, a band gap reference circuit is provided that can prevent Vref from overshooting when the band gap circuit is enabled.

FIG. 1 is a schematic diagram of a band gap reference circuit 100, according to some embodiments. The band gap reference circuit of FIG. 1 comprises a first resistor (R1) 118, a second resistor (R1) 128, a third resistor (R3) 138, a fourth resistor (Ra) 148, a fifth resistor (Rb) 158, a first capacitor (Ca) 192, a first operational amplifier (A) 150, a first field effect transistor (FET) (P1) 110, a second FET (P2) 120, a third FET (P3) 130, a fourth FET (Pa) 140, a first bipolar junction transistor (BJT) (Q1) 160, a second BJT (Q2) 170, and a third BJT (Q3) 180. Transistor P1 110, P2 120, P3 130, and Pa 140 are p-type metal oxide semiconductor field effect transistors (pMOSFETs) in some embodiments. BJTs Q1 160, Q2 170, and Q3 180 comprise a PNP configuration in some embodiments.

Amplifier A 150 comprises a first input 152, a second input 154, and an amplifier output 159. Transistor P1 110 comprises a first gate 112, a first source 114, and a first drain 116. P2 120 comprises a second gate 122, a second source 124, and a second drain 126. P3 130 comprises a third gate 132, a third source 134, and a third drain 136. Pa 140 comprises a fourth gate 142, a fourth source 144, and a fourth drain 146. Q1 160 comprises a first base 162, a first emitter 164, and a first collector 166. Q2 170 comprises a second base 172, a second emitter 174, and a second collector 176. Q3 180 comprises a third base 182, a third emitter 184, and a third collector 186.

In some embodiments, Q2 170 comprises one or more BJTs. For example, Q2 170 comprises n number of BJTs. The respective one or more BJTs comprise a base, an emitter, and a collector. As an example, if Q2 170 comprises two BJTs, such as BJT 170A and BJT 170B, BJT 170A comprises a base 172A, an emitter 174A, and a collector 176A, while BJT 170B comprises a base 172B, an emitter 174B, and a collector 176B. The emitters 174A and 174B are connected to R3 138, while base 172A, base 172B, collector 176A, and collector 176B are connected to ground or a first supply voltage (Vss), which in some embodiments is a negative supply voltage.

The first source 114 of P1 110, the second source 124 of P2 120, and the third source 134 of P3 130 are connected to a second supply voltage (Vdd), which in some embodiments is a positive supply voltage, which provides power to the band gap reference circuit. The first gate 112 of P1 110, the second gate 122 of P2 120, and the third gate 132 of P3 130 are connected to the amplifier output 159 of amplifier A 150. The first drain 116 of P1 110 is connected to R1 118 and R2 128. The second drain 126 of P2 120 is connected to Ra 148 and the fourth source 144 of Pa 140. The third drain 136 of P3 130 is connected to the fourth gate 142 of Pa 140 and Rb 158.

The first input 152 of the amplifier A 150 is connected to R1 118 and the first emitter 164 of Q1 160. The second input 154 of amplifier A 150 is connected to R2 128 and R3 138. In some embodiments, the first input 152 of amplifier A 150 is an inverting input and the second input 154 of amplifier A 150 is a non-inverting input.

The first base 162 of Q1 160, the first collector 166 of Q1 160, the second base 172 of Q2 170, the second collector 176 of Q2 170, the third base 182 of Q3 180, and the third collector 186 of Q3 180 are connected to ground or Vss. The first emitter 164 of Q1 160 is connected to R1 118 and the first input 152 of amplifier A 150. The second emitter 174 of Q2 170 is connected to R3 138. The third emitter 184 of Q3 180 is connected to Ra 148.

The fourth source 144 of Pa 140 is connected to Ra 148 and the second drain 126 of P2 120. The fourth drain 146 of Pa 140 is connected to C1 192 and a reference voltage (Vref) line 190, which is an output of the band gap reference circuit of FIG. 1, according to some embodiments. Additionally, C1 192 is connected to Vss. The fourth gate 142 of Pa 140 is connected to the third drain 136 of P3 130 and Rb 158. Additionally, Rb 158 is connected to Vss.

When the band gap reference circuit is to output a reference voltage at the Vref line 190, power is provided to Vdd. Prior to this, however, when no power is provided to Vdd, the band gap reference circuit is off and the voltage at Vref line 190 is generally equal to zero, in some embodiments.

As mentioned above, the amplifier output 159 of amplifier A 150 is connected to the first gate 112 of P1 110, the second gate 122 of P2 120, and the third gate 132 of P3 130. Because of this, and because these transistors are of a same type, NMOS or PMOS, P1 110, P2 120, and P3 130 are turned on or off in a concurrent fashion based on a voltage (V3) at the amplifier output 159 of amplifier A 150. When P1 110, P2

120, and P3 130 are on, current is able to flow there-through. Amplifier A 150 can thus be said to control current (I1) flowing through the R1 118, current (I2) flowing through R2 128, and current (I3) flowing through Ra 148. Amplifier A 150 forces the voltage potentials V1=V2, where V1 is applied to the inverting input 152 and V2 is applied to the non-inverting input 154 of amplifier A150. In some embodiments, R1 118 comprises a resistance substantially equal to a resistance of R2 128. Accordingly, given that R1 118 and R2 128 are both connected to the first drain 116, I1 is equal to I2 in some embodiments. Therefore, the current flowing into the first BJT 160 is equal to the current flowing into the second BJT 170. In other words:

$|V_{BE1}|-|V_{BE2}|=V_T*\ln(n)$, where $V_T$ is thermal voltage and n is a ratio of the area of second BJT 170 divided by the area of the first BJT 160.

Thus, $I2=(|V_{BE1}|-|V_{BE2}|)/R3=V_T*\ln(n)/R3$

A voltage Va between Ra 148 and P2 120 is equal to V(Ra) plus $|V_{BE3}|$. V(Ra) is equal to current flowing through Ra 148 (I3) multiplied by a resistance of Ra 148. In other words:

$$Va=V(Ra)+|V_{BE3}|=I3*Ra+|V_{BE3}|$$

In some embodiments the current flowing through R2 128 (I2) is substantially equal to the current flowing through Ra 148 (I3), such that I2 is substituted for I3:

$$Va=(V_T*\ln(n)/R3)*Ra+|V_{BE3}|$$

It will be appreciated that when Pa 140 is on, Va is connected to the reference voltage (Vref) line 190, and thus Vref is substantially equal to Va. In other words:

$Vref=(V_T*\ln(n)/R3)*Ra+|V_{BE3}|$, where $V_T$ has a positive temperature coefficient and $|V_{BE3}|$ has a negative temperature coefficient. Therefore, Va can be designed to have a zero, positive or negative temperature coefficient for the specific application.

In some embodiments, P3 130, Ca 192, Pa 140, and Rb 158 are configured to mitigate noise and overshoot issues on the Vref line 190. For example, it is seen that P2 120 and P3 130 are configured to be operated in a concurrent fashion due to the second gate 122 of P2 120 and the third gate 132 of P3 130 being connected to the amplifier output 159 of amplifier A 150, P2 120 and P3 130 being of a same transistor type, and the second source 124 and the third source 134 both being coupled to Vdd.

When power is off and not being provided to Vdd, a voltage potential at the Vref line 190 is substantially zero, because Pa 140 is an open circuit, for example.

When power is provided to Vdd, such as where a power supply associated with Vdd is turned on or off, a spike in voltage occurs on Vdd, in some instances. This spike in voltages causes P1 110, P2 120, and P3 130 to turn on because this spike, which is applied to the first source 114, the second source 124, and the third source 134, generally exceeds V3 provided to the first gate 112, the second gate 122, and the third gate 132. In other words, voltage potentials at Va and Vb are charged to a high level concurrently and in a sudden fashion when power is provided to Vdd.

It will be appreciated that a voltage potential at the Vref line 190 is a function of the degree to which Pa 140 is turned on, where the degree to which Pa 140 is turned is a function of Va and Vb, the voltages provided to the fourth source 144 and the fourth gate 142, respectively. Accordingly, given that Va and Vb both increase or decrease concurrently, the operation or degree to which Pa turns on is controlled. For example, given that Pa 140 is a PMOS transistor, when power is applied to Vdd, and Vb thereby increases suddenly, Pa 140 will pinch off or clamp down to a certain to a degree such that the surge in voltage is substantially blocked from the Vref line 190. For example, current though Pa 140 is limited by the degree to which Pa 140 is pinched by the voltage at Vb. In this manner, the Vref line 190 is maintained at a substantially constant voltage level even when a surge in voltage occurs, such as when Vdd is applied to P2 120 and P3 130. The circuit is thus able to provide a relatively constant Vref voltage level at the Vref line 190 regardless of variations in Vdd. Additionally, capacitor Ca 192 facilitates stabilization of the Vref line 190 because capacitor loading is increased at the Vref line 190. It will be appreciated that the value of Rb 158 can be chosen to assist with controlling the degree to which Pa 140 is turned on or off. For example, the resistance of Rb 158 affects Vb, which, in turn, affects the operation of Pa 140. It will also be appreciated that by controlling the operation of Pa 140, overshoot issues are also overcome. For example, the voltage at the Vref line 190 will not overshoot an intended value when the Vref line 190 is shielded from voltage spikes.

In some embodiments, the band gap reference circuit 100 comprises a voltage reference circuit 100A and a self correction circuit 100B. The voltage reference circuit 100A of the band gap reference circuit 100 is used to generate an intermediate reference voltage, such as the reference voltage at Va. The self correction circuit 100B is used to output a high reliability reference voltage (Vref) at a reference voltage line 190 by preventing overshooting and mitigating power noise or power switch impact, for example.

Figure 2:
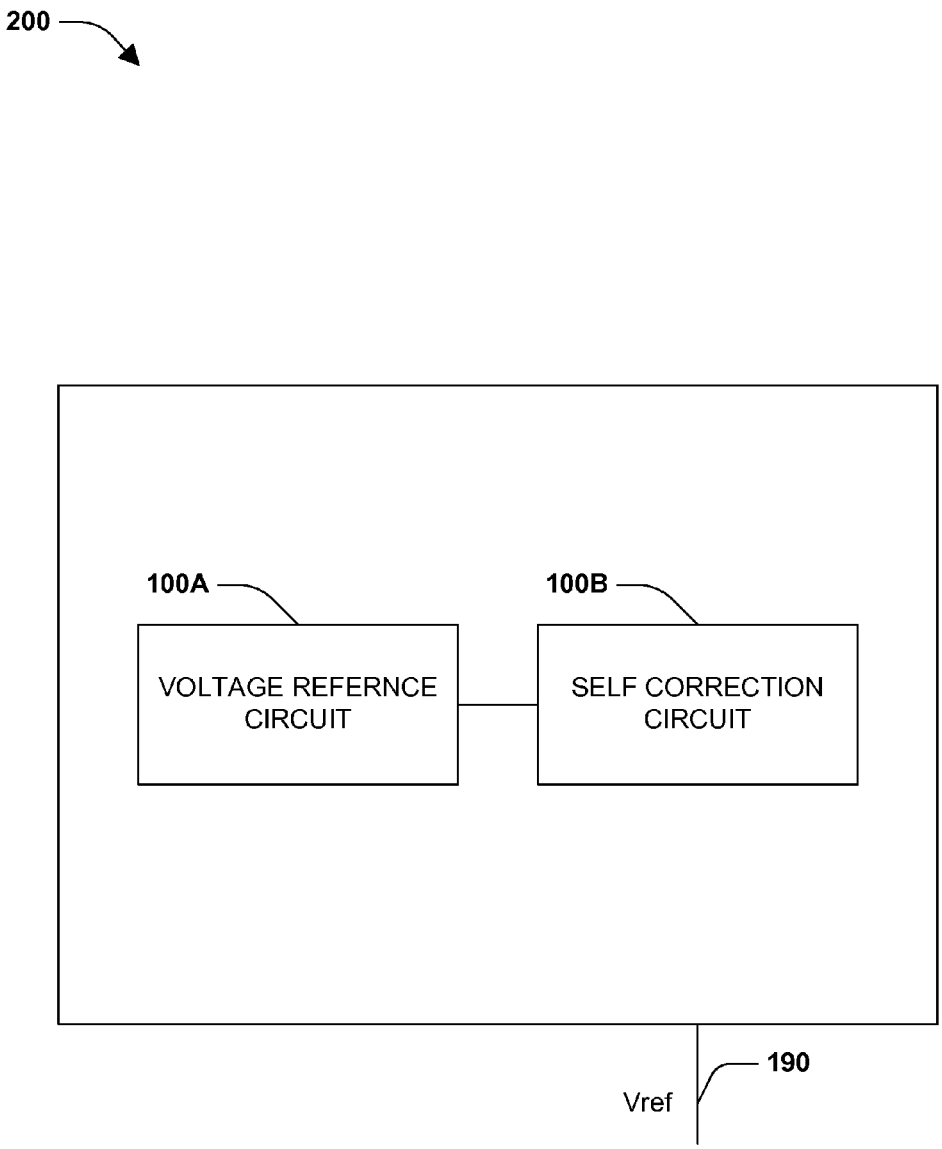
FIG. 2 is a block diagram of a band gap reference circuit, according to some embodiments.

FIG. 2 is a block diagram of a band gap reference circuit 200, according to some embodiments. It will be appreciated that while a band gap reference circuit is mentioned herein, that a band gap reference circuit is merely one type of voltage reference circuit and that other types of voltage reference circuits are within the contemplated scope of the present disclosure. The band gap reference circuit 200 of FIG. 2 comprises a voltage reference circuit 100A and a self correction circuit 100B. The voltage reference circuit 100A is configured to generate an intermediate reference voltage. For example, the voltage reference circuit 100A produces constant voltage or specific voltage trend as the intermediate reference voltage across a variation in process variation, power supply variations, temperature changes, time, loading, etc. The self correction circuit 100B is configured to detect change and do necessary self correction. The self correction circuit 100B is configured to prevent the reference voltage (Vref) in the output of the circuit 200 from overshooting. Additionally, the self correction circuit 100B is configured to enhance reliability of the reference voltage (Vref) in the output of the band gap reference circuit 200 by mitigating power supply level switching or unexpected power supply noise from affecting the output of the band gap reference circuit 200, thereby promoting power noise immunity for the band gap reference circuit 200. The band gap reference circuit 200 is configured to output a reference voltage (Vref) on a reference voltage line 190.

Figure 3:
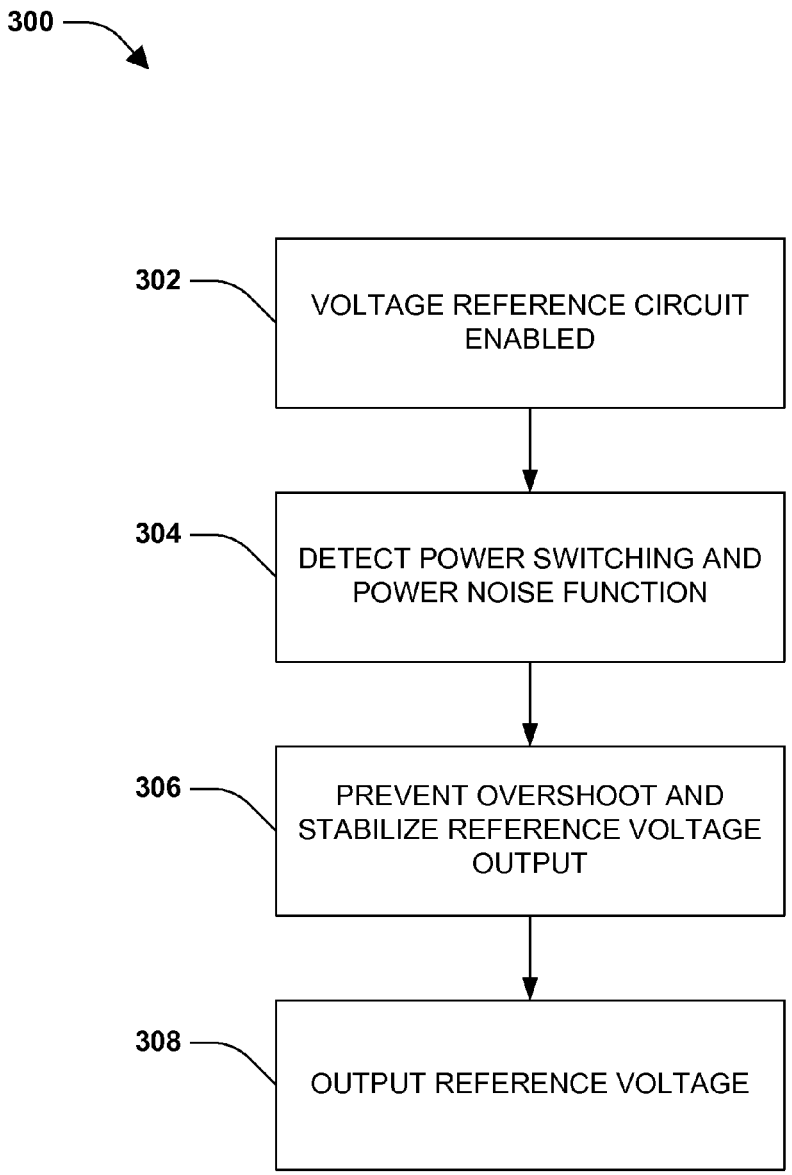
FIG. 3 is a flow diagram for a band gap reference circuit, according to some embodiments.

FIG. 3 is a flow diagram for providing a band gap reference voltage, according to some embodiments. At 302, a voltage reference circuit is enabled. The voltage reference circuit generates an intermediate reference voltage. At 304, power noise effects and power switching effects, such as unexpected power supply noise, switching of a band gap enable signal or switching of a power supply level, are detected. In some embodiments, a self detection circuit is enabled at 304 to accomplish the same. At 306, power noise effects and power switching effects, such as unexpected power supply noise, switching of a band gap enable signal or switching of a power supply level, are corrected. In some embodiments, a self correction circuit is enabled at 306 to accomplish the same. At 306, overshoot of the output reference voltage is prevented and the output reference voltage (Vref) is stabilized. Additionally, the output of the reference circuit is based on the intermediate reference voltage, because the output of the reference circuit is a stabilized intermediate reference voltage. At 308, a high reliability reference voltage (Vref) is provided.

Figure 4:
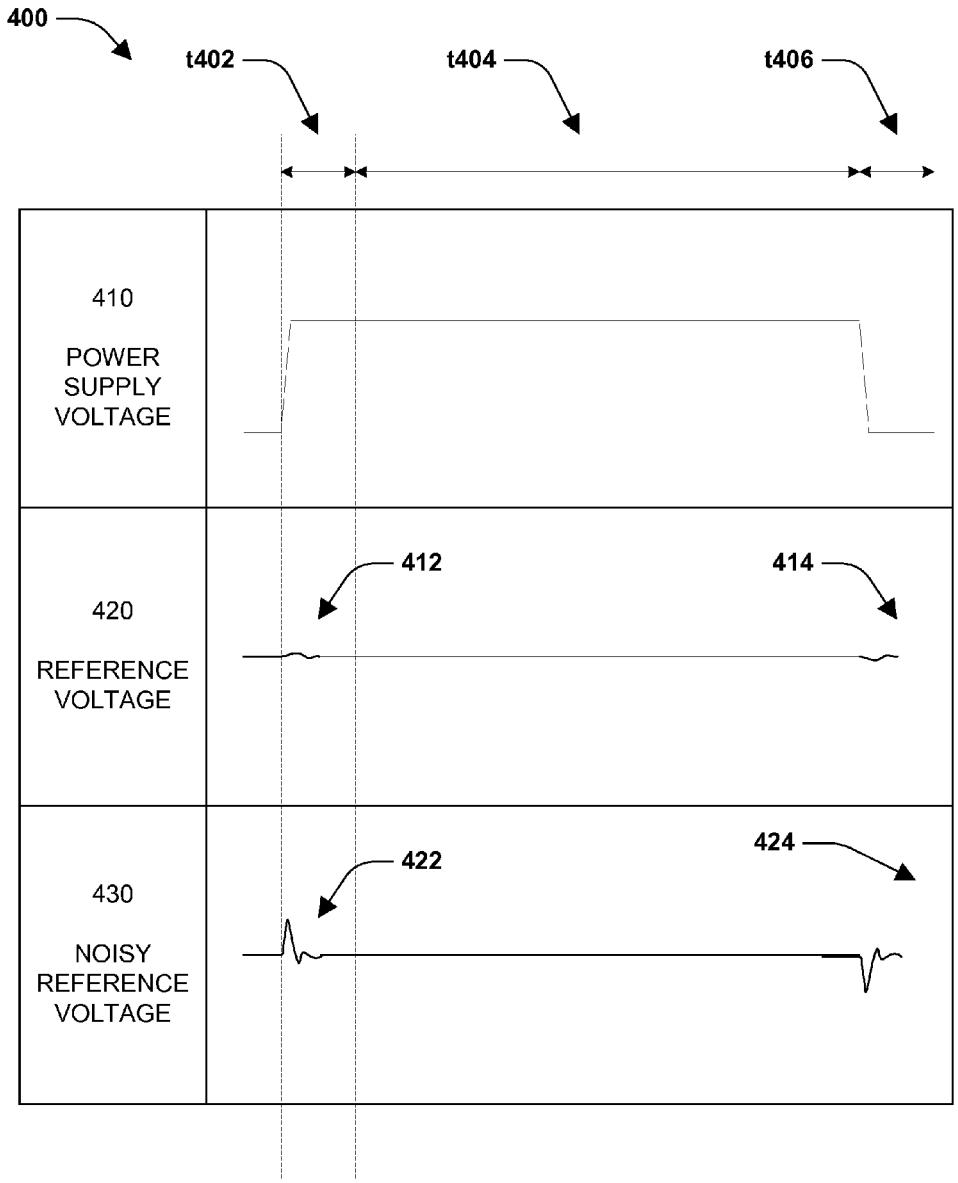
FIG. 4 is a timing diagram associated with a band gap reference circuit, according to some embodiments.

FIG. 4 is a timing diagram 400 associated with a band gap reference circuit, according to some embodiments. With regard to the band gap reference circuit of FIG. 1, 410 is a power supply voltage, such as provided to Vdd, and 420 is a reference voltage, such as output at the Vref line 190. Due to the architecture associated with P3 130, Pa 140, Ca 192, and Rb 158, when the power supply is changed suddenly, such as, for example, when a power supply is changed from 1.5V to 3.6V for wide range power supply operation, at time t402, the power supply voltage 410 has little to no impact on the reference voltage output at the Vref line 190, as seen at 412 of the reference voltage 420. Similarly, when the power supply is changed suddenly, such as, for example, when the power supply is changed from 3.6V to 1.5V for wide range power supply operation, at time t406, it has little to no impact on the reference voltage output at the Vref line 190, as seen at 414 of the reference voltage 420. It will be appreciated that the reference voltage 420 is in contrast to a noisy reference voltage 430 not associated with the band gap reference circuit of FIG. 1. It is seen that the noisy reference voltage is impacted more by activity in the power supply voltage 410 at times t402 and t406, as indicated by 422 and 424, for example.

Figure 5:
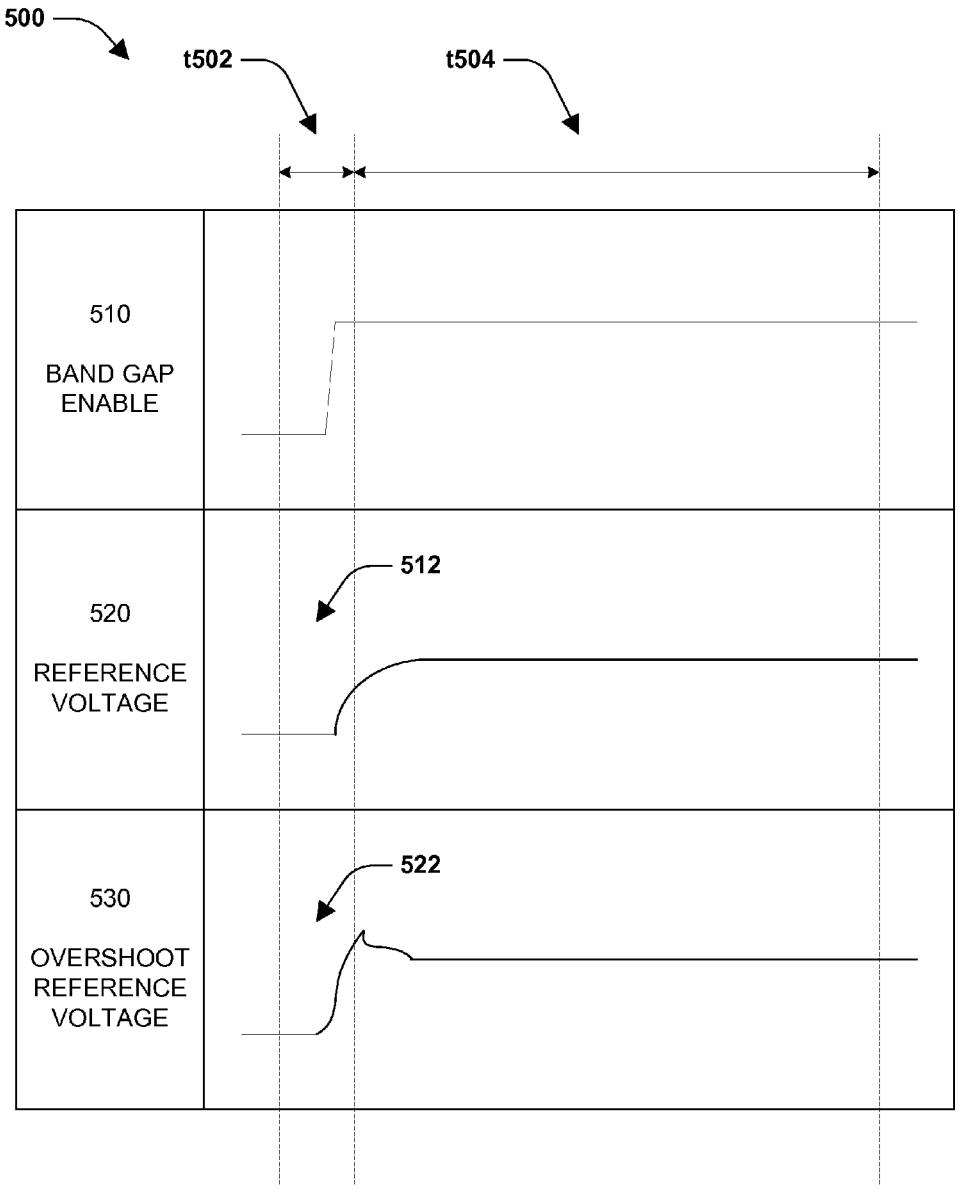
FIG. 5 is a timing diagram associated with a band gap reference circuit, according to some embodiments.

FIG. 5 is a timing diagram 500 associated with a band gap reference circuit, according to some embodiments. With regard to the band gap reference circuit of FIG. 1, 510 is a band gap enable signal, that when switched at time t502, activates a band gap reference circuit, such as the band gap reference circuit of FIG. 1. Due to the architecture associated with P3 130, Pa 140, Ca 192, and Rb 158, when the band gap enable signal 510 is switched to a logic high voltage level at time t502, the reference voltage 520 at the Vref line 190 is activated in a controlled manner, as seen at 512, where no overshoot occurs. At 530, an example of overshooting a reference voltage not associated with the band gap reference circuit of FIG. 1 is illustrated. It is seen that the reference voltage of 530 overshoots 522 or exceeds a voltage level at which the signal eventually settles at, for example.

One or more embodiments of techniques or systems for providing a band gap reference voltage are provided herein. In some embodiments, the band gap reference circuit is substantially temperature independent. In some embodiments, the band gap reference circuit is configured to output a substantially constant reference voltage despite noise associated with power supply level switching or unexpected power supply noise. In some embodiments, the band gap circuit is configured to mitigate overshooting a reference voltage, such as when a power supply is turned on or the band gap circuit is enabled. The band gap reference circuit comprises a first resistor (R1), a second resistor (R2), a third resistor (R3), a fourth resistor (Ra), a fifth resistor (Rb), a capacitor (Ca), an operational amplifier (A), a first field effect transistor (FET) (P1), a second FET (P2), a third FET (P3), a fourth FET (Pa), a first bipolar junction transistor (BJT) (Q1), a second BJT (Q2), and a third BJT (Q3). P3 and Rb are used to control Pa, which is configured to control current flow to a reference voltage (Vref) line.

According to some aspects, a band gap reference circuit is provided, comprising a voltage reference circuit configured to generate an intermediate reference voltage. The band gap reference circuit comprises a self correction circuit configured to prevent overshoot for an output reference voltage, stabilize the output reference voltage based on the intermediate reference voltage, and output the output reference voltage as a high reliability reference voltage (Vref).

According to some aspects, a band gap reference circuit is provided, comprising a first resistor (R1), a second resistor (R2), a third resistor (R3), a fourth resistor (Ra), a fifth resistor (Rb), a first operational amplifier (A), a first field effect transistor (FET) (P1), a second FET (P2), a third FET (P3), a fourth FET (Pa), a first bipolar junction transistor (BJT) (Q1), a second BJT (Q2), a third BJT (Q3), and a first capacitor (Ca). Amplifier A comprises a first input, a second input, and an amplifier output. The second input of amplifier A is connected to R2 and R3. P1 comprises a first gate, a first source, and a first drain. The first drain of P1 is connected to R1 and R2. P2 comprises a second gate, a second source, and a second drain. P3 comprises a third gate, a third source, and a third drain. The first gate, the second gate, and the third gate are connected to the amplifier output of amplifier A. Pa comprises a fourth gate, a fourth source, and a fourth drain. The fourth source is connected to the second drain and Ra. The fourth gate is connected to the third drain and Rb. The fourth drain is connected to Ca. Q1 comprises a first base, a first emitter, and a first collector. The first emitter is connected to the first input of amplifier A and R1. Q2 comprises a second base, a second emitter, and a second collector. The second emitter is connected to R3. Q3 comprises a third base, a third emitter, and a third collector. The third emitter is connected to Ra.

According to some aspects, a method for providing a high reliability reference voltage is provided. The method comprises enabling a voltage reference circuit, detecting band gap enabling function, power switching function and power noise function. The method comprises preventing overshoot for an output reference voltage and stabilizing the output reference voltage based on an intermediate reference voltage. The method comprises outputting the output reference voltage as a high reliability reference voltage.

Although the subject matter has been described in language specific to structural features or methodological acts, it is to be understood that the subject matter of the appended claims is not necessarily limited to the specific features or acts described above. Rather, the specific features and acts described above are disclosed as exemplary embodiments.

Various operations of embodiments are provided herein. The order in which some or all of the operations are described should not be construed as to imply that these operations are necessarily order dependent. Alternative ordering will be appreciated based on this description. Further, it will be understood that not all operations are necessarily present in each embodiment provided herein.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used in either the detailed description or the claims, such terms are intended to be inclusive in a manner similar to the term "comprising".

Further, unless specified otherwise, "first," "second," or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel.

Also, although the disclosure has been shown and described with respect to one or more implementations, equivalent alterations and modifications will occur based on a reading and understanding of this specification and the annexed drawings. The disclosure includes all such modifications and alterations and is limited only by the scope of the following claims.

What is claimed is:

1. A band gap reference circuit, comprising:
a first resistor (R1), a second resistor (R2), a third resistor (R3), a fourth resistor (Ra), and a fifth resistor (Rb);
a first operational amplifier (A) comprising a first input, a second input, and an amplifier output, the second input of amplifier A connected to R2 and R3;
a first field effect transistor (FET) (P1) comprising a first gate, a first source, and a first drain, the first drain of P1 connected to R1 and R2;
a second FET (P2) comprising a second gate, a second source, and a second drain;
a third FET (P3) comprising a third gate, a third source, and a third drain, the first gate, the second gate, and the third gate connected to the amplifier output of amplifier A;
a fourth FET (Pa) comprising a fourth gate, a fourth source, and a fourth drain, the fourth source connected to the second drain and Ra, the fourth gate connected to the third drain and Rb, the fourth drain connected to a first capacitor (Ca);
a first bipolar junction transistor (BJT) (Q1) comprising a first base, a first emitter, and a first collector, the first emitter connected to the first input of amplifier A and R1;
a second BJT (Q2) comprising a second base, a second emitter, and a second collector, the second emitter connected to R3; and
a third BJT (Q3) comprising a third base, a third emitter, and a third collector, the third emitter connected to Ra.

2. The band gap reference circuit of claim 1, at least one of Q1, Q2, or Q3 comprising a PNP configuration.

3. The band gap reference circuit of claim 1, where at least one of P1, P2, P3, or Pa is a p-type metal oxide semiconductor field effect transistor (pMOSFET).

4. The band gap reference circuit of claim 1, at least one of the first source of P1, the second source of P2, or the third source of P3 connected to a second supply voltage (Vdd).

5. The band gap reference circuit of claim 1, at least one of the first base of Q1, the second base of Q2, or the third base of Q3 connected to a first supply voltage (Vss).

6. The band gap reference circuit of claim 1, at least one of the first collector of Q1, the second collector of Q2, or the third collector of Q3 connected to a first supply voltage (Vss).

7. The band gap reference circuit of claim 1, the first input of amplifier A comprising an inverting input.

8. The band gap reference circuit of claim 1, the second input of amplifier A comprising a non-inverting input.

9. The band gap reference circuit of claim 1, R1 comprising a resistance substantially equal to a resistance of R2.

10. The band gap reference circuit of claim 1, the fourth drain of Pa connected to a reference voltage (Vref) line.

11. The band gap reference circuit of claim 1, Ca connected to a first supply voltage (Vss).

12. The band gap reference circuit of claim 1, Rb connected to a first supply voltage (Vss).

13. A band gap reference circuit, comprising:
a first resistor (R1), a second resistor (R2), a third resistor (R3), and a fourth resistor (Ra);
a first operational amplifier (A) comprising a first input, a second input, and an amplifier output, the second input of amplifier A connected to R2 and R3;
a first field effect transistor (FET) (P1), wherein:
a first source/drain region of P1 is connected to R1 and R2,
a second source/drain region of P1 is connected to a second supply voltage (Vdd), and
a gate of P1 is connected to the amplifier output; and
a second FET (P2), wherein:
a first source/drain region of P2 is connected to Vdd,
a second source/drain region of P2 is connected to Ra, and
a gate of P2 is connected to the amplifier output and the gate of P1.

14. The band gap reference circuit of claim 13, comprising:
a fourth FET (Pa), wherein:
a first source/drain region of Pa is connected to the second source/drain region of P2 and Ra, and
a second source/drain region of PA is connected to an output terminal of the band gap reference circuit.

15. The band gap reference circuit of claim 14, comprising:
a third FET (P3), wherein:
a first source/drain region of P2 is connected to Vdd,
a second source/drain region of P3 is connected to a gate of Pa, and
a gate of P3 is connected to the amplifier output, the gate of P1, and the gate of P2.

16. The band gap reference circuit of claim 15, comprising:
a fifth resistor (Rb), wherein:
the second source/drain region of P3 is connected to a first terminal of Rb; and
a second terminal of Rb is connected to a first supply voltage (Vss).

17. The band gap reference circuit of claim 14, comprising:
a first capacitor (Ca), a first terminal of the first Ca coupled to the second source/drain region of PA.

18. The band gap reference circuit of claim 17, a second terminal of the first Ca coupled to a first supply voltage (Vss).

19. The band gap reference circuit of claim 13, comprising:
a third BJT (Q3) connected to Ra.

20. A band gap reference circuit, comprising:
a first resistor (R1) and a second resistor (R2);
a first operational amplifier (A) comprising a first input, a second input, and an amplifier output, the second input of amplifier A connected to R2;
a first field effect transistor (FET) (P1), wherein:
a first source/drain region of P1 is connected to R1 and R2,
a second source/drain region of P1 is connected to a second supply voltage (Vdd), and
a gate of P1 is connected to the amplifier output;
a second FET (P2), wherein:
a first source/drain region of P2 is connected to Vdd, and
a gate of P2 is connected to the amplifier output and the gate of P1; and
a fourth FET (Pa), wherein:
a first source/drain region of Pa is connected to the second source/drain region of P2, and
a second source/drain region of PA is connected to an output terminal of the band gap reference circuit.

* * * * *